United States Patent [19]

Debaes

[11] Patent Number: 4,614,210

[45] Date of Patent: Sep. 30, 1986

[54] LENO DEVICE FOR WEAVING MACHINES AND WEAVING MACHINES EQUIPPED WITH SUCH A LENO DEVICE

[75] Inventor: Johnny Debaes, Wevelgem, Belgium

[73] Assignee: N. V. Michel Van De Wiele, Kortrijk, Belgium

[21] Appl. No.: 704,591

[22] Filed: Feb. 22, 1985

[30] Foreign Application Priority Data

Feb. 21, 1984 [BE] Belgium ..... 898.963

[51] Int. Cl.[4] ..... D03C 11/00

[52] U.S. Cl. ..... 139/54

[58] Field of Search ..... 139/54

[56] References Cited

U.S. PATENT DOCUMENTS

| | | | |
|---|---|---|---|
| 3,256,913 | 6/1966 | Neumann | 139/54 |
| 3,369,570 | 2/1968 | Lacy | 139/54 |
| 3,561,496 | 2/1971 | Guallo | 139/54 |

*Primary Examiner*—Henry S. Jaudon

*Attorney, Agent, or Firm*—James C. Wray

[57] ABSTRACT

Leno device for weaving machines, preferably double rapier weaving machines for plain velvet or carpets, designed to obtain non-fraying edges, characterized by the leno device concerned being fitted with one or more parallelograms of bars with vertical sides, the front of which is fitted with thread guides and the back of which is held in the vertical position while the adjacent bars are free to pivot around pivot points at the corner points of the parallelogram, so that the thread guides can move up- and downwards.

16 Claims, 5 Drawing Figures

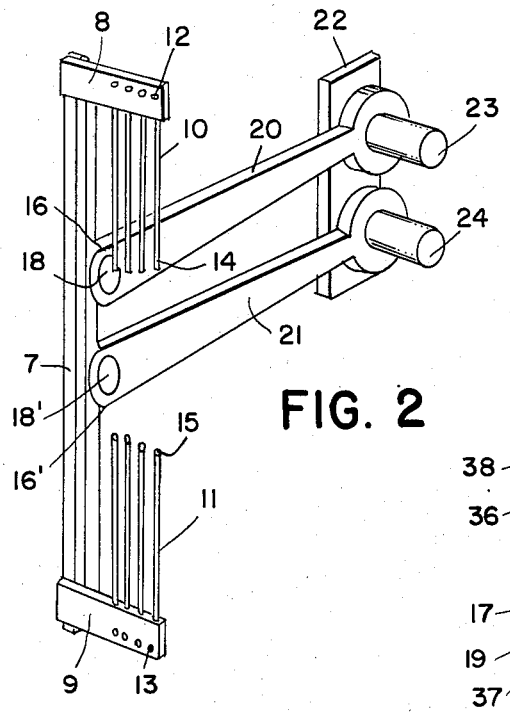
FIG. 2
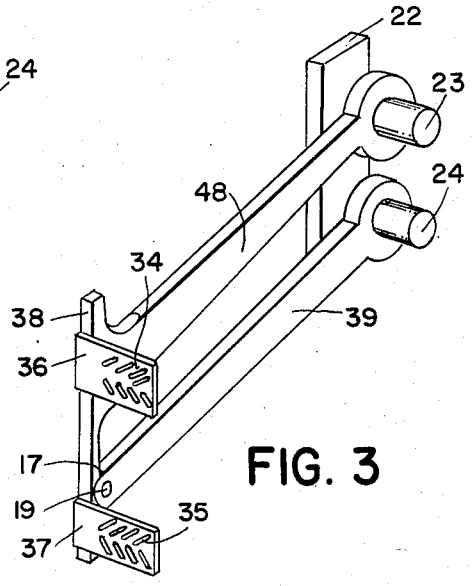
FIG. 3
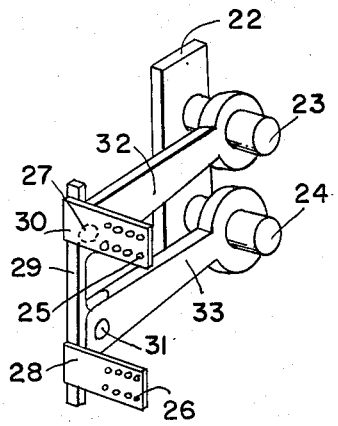
FIG. 4
FIG. 5
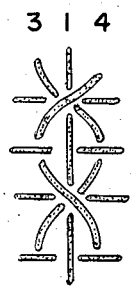

LENO DEVICE FOR WEAVING MACHINES AND WEAVING MACHINES EQUIPPED WITH SUCH A LENO DEVICE

BACKGROUND OF THE INVENTION

The invention relates to a leno device for weaving machines, preferably double rapier weaving machines for plain velvet or carpets, designed to obtain non-fraying edges.

Leno devices are used in a weaving loom in order to position a part of the warp ends, the so-called leno threads, first to the right and then to the left of the standing threads such that the leno threads are wound or slung around the standing threads.

The device required to execute this operation is rather complicated, and various attempts have already been made to simplify it.

Among these, a solution was specified in German Gebrauchmuster No. 80 05 822 published on July 7, 1980, whereby on one hand the standing threads are positioned by means of needles and on the other hand the leno threads are positioned by the respective movements of healds fitted with eyes and of a guide plate fitted with inclined slots through which the leno threads are guided. This leno device requires three shed motions with their associated weaving frames, namely a weaving frame with 1/1 movement for the needle bar, a weaving frame with 1/1 movement for the slot bar and a weaving frame with 2/2 movement for the leno thread positioning eyes.

Naturally, this is in itself not a simple drive, which requires three elements of the existing shed motion installation, such as a dobby mechanism or a cam mechanism. Furthermore, leno device cannot be separately timed with respect to the main shaft.

U.S. Pat. No. 3,369,570 shows a leno salvage device that includes a carrier with vertically spaced needle blocks equipped with vertically opposed needles and friction rods. Also, a leno bar is slideably received in a slot extending through the leno bar. This disclosure concerns a device associated with and dependent on a particular weaving frame and suffers from the aforementioned disadvantages in that it does not have a simple drive, cannot be separately timed with respect to the main shaft and cannot be practised in double rapier machines without difficulties.

SUMMARY OF THE INVENTION

The purpose of the invention is to construct a leno device for which the drive is independent of the dobby mechanism, which does not require any supplementary weaving frames and for which the timing adjustment with respect to the main shaft is individually adjustable.

The leno device for a weaving machine as described by the invention is characterized by four-element parallelogram with vertical fronts to which the needles, slot holders and thread positioning eyes are respectively attached, while the vertical back carries the pivots around which the other bars of the parallelograms pivotally mount, so that needles, slot holders and positioning eyes all remain vertical in their movement and merely describe a very small arc.

The elements which compose the parallelograms may be built alongside each other in a modular manner on pivots which are firmly attached to a frame and adjustable in width.

BRIEF DESCRIPTION OF THE DRAWINGS

FIG. 2 is a perspective view of the standing thread parallelogram found in FIG. 1.

FIG. 3 is a perspective view of the slot-holders parallelogram found in FIG. 1.

FIG. 4 is a perspective view of the positioning eyes parallelogram found in FIG. 1.

FIG. 5 is a view of the weave achieved by the leno device of FIG. 1.

DETAILED DESCRIPTION OF THE DRAWINGS

Figure 1:
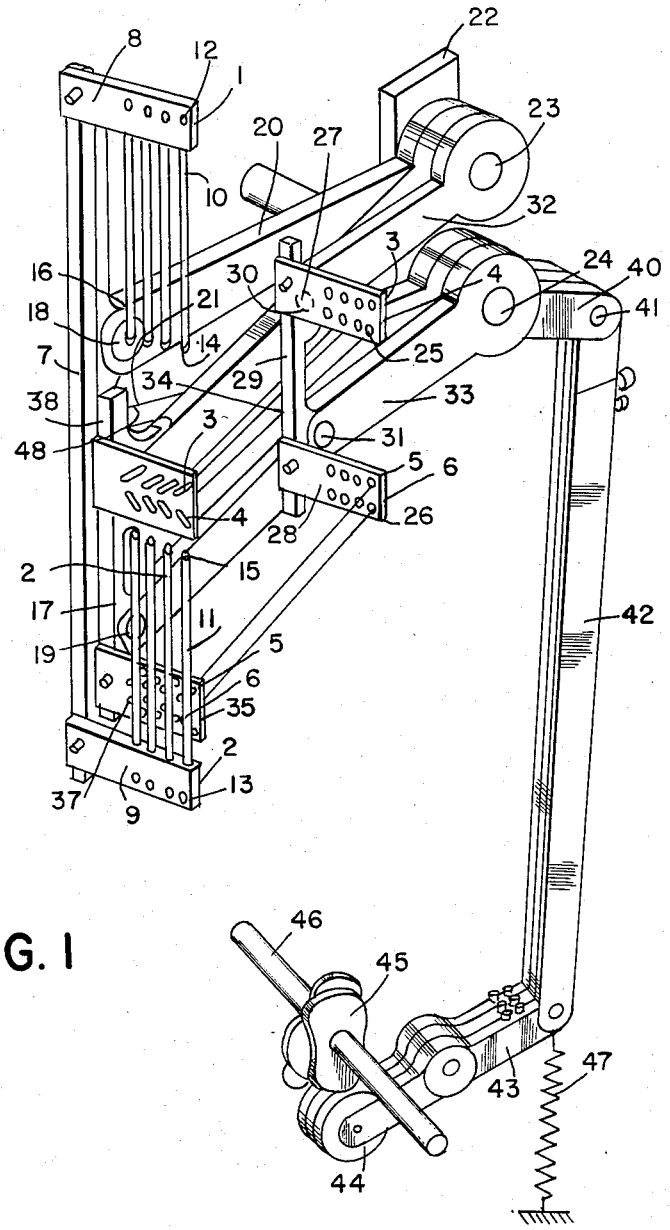
FIG. 1 is a perspective view of the leno device.

In a leno device for a weaving machine as illustrated in the attached diagram, the warp ends are divided into standing threads 1 and 2 and into leno threads 3, 4, 5, 6, etc.

The leno device as described by the invention is composed of separate bar parallelograms. On both extremities of their vertical front bar 7, the bar parallelograms of the standing threads 1 and 2 carry a needle holder 8 and a needle holder 9 respectively, in which the uppermost needles 10 and the bottommost needles 11 are aligned vertically. Needle holders 8 and 9 are fitted with positioning eyes 12 and 13, through which the standing threads 1 and 2 are guided, then to be taken further on to the comb (not illustrated) of the weaving machine via needles 10 and 11 and the needle eyes 14 and 15. The vertical front bar 7 of the standing thread parallelogram is fitted with pivots 16 and 16' respectively with their bolts 18 and 18', around which the adjacent elements of the parallelogram are pivoting, while the rearmost vertical side is formed by rear vertical bar 22 fitted with an uppermost shaft 23 and a bottommost shaft 24, around which the uppermost situated arm 20 and the bottommost situated arm 21 respectively are pivotally mounted, with the result that the front bar 7 of the standing threads is able to move up and down while the needles are held in the vertical position as shaft 24 firmly is fixed to the frame of the loom and only adjustable in width according to the width of the weave and maintains rear vertical bar 22 in a vertical position.

The leno threads 3, 4, and 5, 6, are moved in a similar manner by positioning eyes 25 and 26 respectively, the holders 27 and 28 of which are attached to the vertical bar 29 which forms the vertical front of the parallelogram of positioning eyes 25 and 26 and which is fitted with two pivots 30 and 31 for the adjacent arms 32 and 33, which are pivotally mounted around the shafts 23 and 24, while rear vertical bar 22 forms the back of the parallelogram of positioning eyes 25 and 26 of the leno threads 3, 4, 5, 6, etc.

In a similar manner, the leno threads 3, 4, and 5, 6, pass further through respective slots 34 and 35, the holders 36 and 37 of which are attached to the extremities of the vertical bar 38, which forms the front of the parallelogram of slot holders 36 and 37, further composed of the adjacent arms 48 and 39 and the rear vertical bar 22 as rearmost vertical side.

The quadrilateral parallelogram of bars and arms is constructed in a modular manner side by side on pivots which are firmly attached to a frame and adjustable in width according to the weaving width. The height of the needles, slots and eyes may be adjusted with the vertical draw bar by means of adjusting screws.

The bottommost arms 21, 33 and 38 of the parallelogram each have an extension piece 40, and a pivot pin 41 on their extremity, each couples via levers 42 and 43 to a cam follower 44. Via cams 45, the rotation of camshaft 46 and tensioning springs 47, this cam follower 44 produces an up and down movement of the front vertical bars, the parallelogram of needles, the slot holder parallelogram and the parallelogram of positioning eyes.

The timing setting is set up by adjusting the cams 45 on camshaft 46. This shaft rotates in ratio ¼ to the main shaft, so that needles 10 and 11 execute a 1/1 movement, the slots 34, 35, etc. execute a 1/1 movement in antiphase while the positioning eyes 25 and 26 execute a 2/2 movement.

What is claimed is:

1. Leno salvage forming device for double rapier weaving machines, designed to obtain non-fraying edges, characterized by the leno device concerned being fitted with at least one parallelogram device with two vertical members, the front of which is fitted with thread guides and the back of which is fixed to the loom frame in vertical position, while the adjacent members are free to pivot around pivotpoints at the corner points of the parallelogram device, so that the thread guides can move up- and downwards.

2. Leno device as described in claim 1 characterised by there being a first parallelogram of bars for standing threads and a second for leno threads.

3. Leno device as described in claim 1 characterized by the parallelogram bars of the standing threads being fitted with needle holders to which vertical needles are attached along the lines where the standing threads run.

4. Leno device as described in claim 1 characterized by the parallelogram of leno threads being fitted with slot holders with inclined slots through which the leno threads are guided.

5. Leno device as described in claim 1 characterized by the leno threads being positioned in the slots by the use of positioning eyes made in a leno thread guide and carried by the vertical side of a further parallelogram of bars.

6. Leno device as described in claim 1 characterized by the parallelograms of bars side by side in a modular manner being mounted on common rotation points of the back vertical member which are firmly attached with a holder to the loom frame.

7. Leno device as described in claim 1 characterized by the parallelogram bearers being adjustable in the widthways direction of the weaving machines by the sliding of holders in brackets on the main frame.

8. Leno device as described in claim 1 characterized by the leno device thread holders and guides being adjustable in absolute height by means of adjusting screws in the vertical bar of the parallelogram concerned.

9. Leno device as described in claim 1 characterized by a sliding lever on the lower part with adjusting screws which adjust the shed of the leno device threads.

10. Leno device as described in claim 1 characterized by the fact that the left and right hand side device can be timed individually by cams on a cam shaft to the weaving machine.

11. Leno salvage forming device for weaving machines designed to obtain non-fraying edges, comprising, at least one parallelogram of bars and having vertical sides, a front side having thread guides fitted thereto, and a back side being held in its vertical position, adjacent arms being pivotally connected to pivot joints located at corner points of the parallelogram, whereby the thread guides, upon pivotal upward or downward movement of the adjacent arm, likewise move upward or downward in a vertical plane.

12. The device of claim 11 comprising two parallelograms of bars, the first being adapted for standing threads, the second being adapted for leno threads.

13. The device of claim 12 wherein the first parallelogram of bars further comprises, needle holders fitted to the front side and being held in a vertical plane therewith, and vertical needles attached to the needle holders and extending in lines where the standing threads run.

14. The device of claim 12 wherein the second parallelogram of bars further comprises, slot holders fitted to the front side and being held in a vertical plane therewith and having inclined slots through which the leno threads are guided.

15. The device of claim 14 further comprising a third parallelogram of bars having a leno thread guide fitted to the front side, the leno thread guide having positioning eyes adapted to position the leno threads with respect to the inclined slots.

16. The device of claim 15 wherein all three parallelograms of bars are mounted side by side with common rotation points.

* * * * *